United States Patent [19]

Sawatari et al.

[11] Patent Number: 4,849,317

[45] Date of Patent: Jul. 18, 1989

[54] MAGNETIC BRUSH DEVELOPER FOR ELECTROPHOTOGRAPHY

[75] Inventors: Norio Sawatari, Sagamihara; Katsuji Ebisu, Isehara; Tsuneo Watanuki, Atsugi; Yoshimichi Katagiri, Chigasaki; Takahiro Kashikawa; Toshiaki Narusawa, both of Sagamihara, all of Japan

[73] Assignee: Fujitsu Limited, Kawasaki, Japan

[21] Appl. No.: 68,162

[22] Filed: Jun. 30, 1987

[30] Foreign Application Priority Data

Jun. 30, 1986 [JP] Japan ..... 61-151573

[51] Int. Cl.[4] ..... G03G 9/14

[52] U.S. Cl. ..... 430/106.6; 430/108

[58] Field of Search ..... 430/110, 106.6, 108

[56] References Cited

U.S. PATENT DOCUMENTS

| | | | |
|---|---|---|---|
| 2,874,063 | 2/1959 | Greig | 430/106.6 |
| 4,233,387 | 11/1980 | Mammino et al. | 430/137 |
| 4,560,635 | 12/1985 | Hottend et al. | 430/106.6 |
| 4,652,510 | 3/1987 | Fushida et al. | 430/106.6 |

FOREIGN PATENT DOCUMENTS

| | | |
|---|---|---|
| 0032125 | 7/1981 | European Pat. Off. . |
| 0052502 | 5/1982 | European Pat. Off. . |
| 060703 | 9/1982 | European Pat. Off. . |
| 0165408 | 10/1985 | European Pat. Off. . |

*Primary Examiner*—John L. Goodrow

*Attorney, Agent, or Firm*—Staas & Halsey

[57] ABSTRACT

A magnetic brush developer for electrophotography by the reversal development system where a uniform positive charge is imparted to a photoconductive insulator, the insulator is irradiated with a light image to form an electrostatic latent image and the latent image is developed and visualized by a positively charged toner. The developer comprises a carrier of granulated magnetite particles, the surfaces of which are coated with a thermosetting resin containing a fine fluoropolymer powder and a fine magnetite or carbon black powder dispersed therein. When this developer is used, adhesion of the toner to the sleeve is not only prevented at the initial stage of printing but also after continuous printing, and even if continuous printing does conducted, the charge quantity is not reduce, therefore print quality does not degrade.

8 Claims, 5 Drawing Sheets

MAGNETIC BRUSH DEVELOPER FOR ELECTROPHOTOGRAPHY

BACKGROUND OF THE INVENTION

1. Field of the Invention

The present invention relates to a magnetic brush developer for use in developing an electrostatic latent image in electrophotography or the like.

2. Description of the Related Art

The process disclosed in U.S. Pat. No. 2,297,691 is known as an electrophotographic process. According to this process, in general, a uniform static charge is applied to a photoconductive insulator by corona discharge or the like, the insulator is then exposed imagewise to light by various means to form an electrostatic latent image. The latent image is then developed and visualized by a fine powder called "a toner". The toner image is transferred onto a paper sheet or the like according to need, and the transferred toner image is then fixed by compression, application of heat, a solvent vapor or light to obtain a print.

As the toner for developing an electrostatic latent image, particles obtained by pulverizing a dispersion of a colorant such as carbon black in a binder resin composed of a natural or synthetic polymeric substance of about 1 to 30 μm have been used. Generally, the toner is mixed with a carrier such as iron powder to form a magnetic brush developer, and this developer is used for developing an electrostatic latent image.

The process for developing the electrostatic latent image is roughly divided into two methods. The first is a positive development method in which toner particles having a reverse polarity to that of a photoconductive insulator (photoconductor) adhere to the static charge-remaining region on the photoconductor. The second is a reversal development method in which toner particles having the same polarity as that of the photoconductor adhere to the static charge-free region. In the reversal development method, a direct current voltage (bias voltage) having the same polarity as that of the latent image is applied to a magnetic roll (sleeve) to effect the transfer of the developer. In conventional copying machines, the positive development method is mainly used, but where the positive development method is used in a laser printer, the printing ratio is ordinarily a few %, and it is therefore necessary to irradiate a major portion of the photoconductor with light to erase the static charge. Problems arise in connection with the short life of the laser and the precision of the optical system. Accordingly, the reversal development method is often used in conventional laser printers.

The problem in the reversal development process is that the toner adheres to the sleeve while development is repeated. If this adhesion occurs, the sleeve becomes an insulator and it becomes impossible to apply the development bias voltage, with the result that a sharp and clearn image cannot be obtained. This phenomenon occurs because the toner is attracted to the sleeve by the electrostatic repulsive force generated when the polarity of the toner is the same as that of the static charge, and by the electric lines of force generated according to the voltage difference between the photoconductor (high voltage) and the sleeve (low voltage). This phenomenon occurs frequently when the gap between the photoconductor and the sleeve is narrow.

Contributions of the constituent materials of the developer to the development will now be described. An important role of the carrier is to give an appropriate charge to the toner. Since this charging is caused by electrostatic friction between the toner and carrier, setting of the tribo-electric series for the toner and carrier is important. If the developer is used for a long time, so-called toner filming, that is, adhesion of the toner to the surface of the carrier, results this changes the charging characteristics of the carrier with the result that it becomes impossible to impart a sufficient charge to the toner and the print quality is therefore degraded. If the toner charge is reduced simultaneously with or before this degradation, the toner will be apt to separate from the carrier and a toner coating readily forms on the sleeve. The adhesion of toner to the sleeve is therefore caused by repetition of the development. To eliminate this disadvantage, the reduction of the tribo-electric property in continuous printing must be prevented by appropriate control of the tribo-electric coordinates (positions in tribo-electric series) for the toner and carrier. For this purpose, it is necessary to coat the surfaces of carrier particles with a resin which is non-sticky to the toner.

To prevent adhesion of the toner to the sleeve, control of the tribo-electric coodinates for the toner and carrier is especially important. As a means for imparting positive chargeability or negative chargeability, a method has been adopted in which a positive charge control agent or negative charge control agent is added to the toner. However, if this method is adopted, the self chargeability of the toner per se is increased and the toner is readily attracted by an electric field directed to the sleeve from the photoconductor, therefore a coating of the toner readily forms on the sleeve. As pointed out above, adhesion of the toner to the sleeve is a serious problem for a printer in which the reversal development process is adopted. This problem must be solved by improving the developer.

In the two-component type magnetic brush developer previously mentioned, the problem of toner adhesion to the surface of the carrier is generally caused by physical contact between the carrier and toner. Therefore, if the tribo-electric property of the toner changes, the electric resistance of the carrier changes and the image quality becomes degraded. For example, development of solid areas becomes impossible. Accordingly, it is desirable to provide a developer in which the tribo-electric property and the electric conductivity of the carrier changes little or not at all, even after continuous printing.

Another problem concerning the toner for electrophotography resides in the fixation process. The fixation process involves melting the toner powder image and fixing the toner image to a paper. There are various fixing methods as described above, but in conventional copying machines and printers, fixation by hot roll is commonly adopted. In hot roll fixation the toner is generally a binder resin comprising a low-molecular-weight component and a high-molecular-weight component is used. More specifically, a sufficient fixing quality is obtained by the low-molecular-weight component and offsetting of the hot roll is prevented by the high-molecular-weight component. It is considered that offsetting is a cohesive failure which occurs when the adhesive force between the toner and the hot roll is greater than the cohesive force of the toner. Accordingly, to prevent offsetting, a wax must be added to reduce the adhesive force between the toner and the hot roll or rather, a stronger cohesive force must exist in the polymer molecules of the molten toner relative to the adhesive force of the same. Polypropylene or montanic acid wax is generally used. However, use of a wax is not preferred because the flowability of the toner is degraded such that toner filming of the photoconductor causes an increase in the background image. Although a method is often adopted in which the ratio of the high-molecular-weight component in the binder resin is increased to improve the cohesive force of the toner, this method is not preferred because toner fixing quality is degraded. Accordingly, a binder resin capable of imparting a good fixing property and an excellent offset-preventing property is desired.

SUMMARY OF THE INVENTION

It is therefore a primary object of the present invention to provide a developer which does not cause adhesion of the toner to the sleeve, specifically one which contains an alumite-treatment aluminum either initially or after continuous printing.

Another object of the present invention is to provide a long-life developer in which change of the triboelectric property by continuous printing does not occur, and thus print quality is maintained.

Still another object of the present invention is to provide a developer which does not cause toner filming on the surface of the carrier even after continuous printing, and therefore does not cause a substantial decrease in the electric conductivety of the carrier.

A further object of the present invention is to provide a developer which does not cause offsetting at the hot roll even without using a wax and produces excellent fixing quality even at lower fixation temperatures.

In accordance with the present invention, there is provided a magnetic brush developer for the reversal development method of electrophotography where a uniform positive charge is imparted to a photoconductor. The photoconductor is irradiated with a light image to form an electrostatic latent image and the latent image is developed and visualized by a positively charge toner. The developer comprises a toner having a substantially negative chargeability and a carrier comprising magnetite particles, the surface of which are coated with a resin having a stronger negative chargeability than that of the toner in the tribo-electric coordinates.

More specifically, the present invention provides a magnetic brush developer for the reversal development method of electrophotography where a uniform positive charge is imparted to a photoconductor, the photoconductor is irradiated with a light image to form an electrostatic latent image and the latent image is developed and visualized by a positively charged toner. The developer comprises a carrier having granulated mgnetite particles, the surface of which are coated with a thermosetting resin containing a fine fluoropolymer powder and a fine magnetite or carbon black powder dispersed therein.

For example, according to the present invention, a magnetic brush developer comprises a carrier and a toner. The carrier comprises a resin layer formed by coating the surfaces of granulated magnetite particles with a heat-curable resin. The toner comprises a binder of polyester resin having a crosslinked molecular structure and a gel fraction of 5 to 25%.

DETAILED DESCRIPTION OF THE PREFERRED EMBODIMENT

Figure 1:
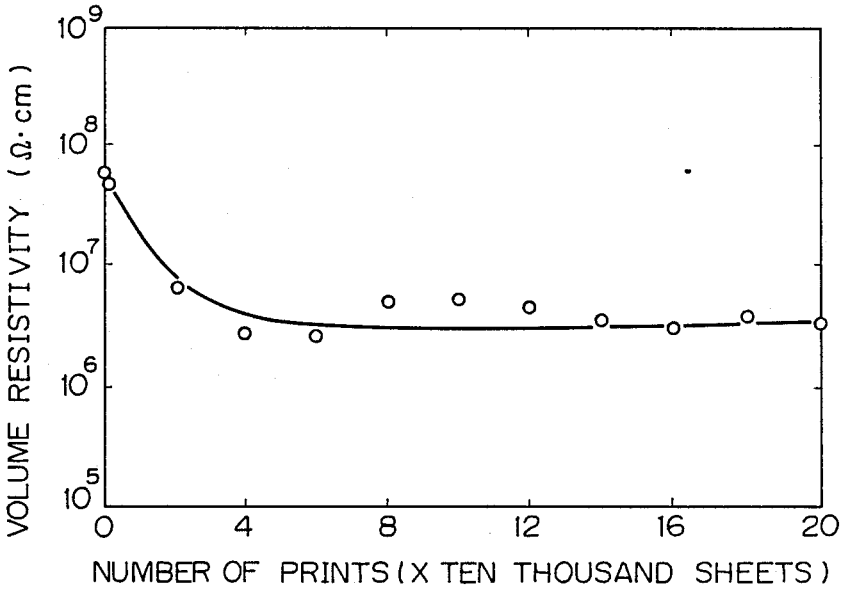
FIG. 1 is a graph showing the change in volume resistivity of the carrier during continuous printing.

The granulated magnetite particles used in the present invention are spherical in shape and have a diameter of 50 to 150 μm. The thickness of the resin coating layer is 0.1 to 10 μm. Preferably a fluoropolymer powder is contained in the coating resin and the volume resistivity of the carrier after coating is $10^3$ to $10^{10}$ Ω-cm. The fluorine resin powder can be used for imparting a strong negative chargeability to the coating resin. The electric resistance can be controlled by dispersing a fine magnetite powder or carbon black powder in the coating resin.

The polyester resin used as a binder resin for the toner has a softening temperature of 125° to 155° C. and a glass transition temperature of 60° to 75° C. Preferably the polyester resin contains 5 to 30 mole% of trimellitic acid or its anhydride as a crosslinking agent.

Furthermore, the tribo-electric charge of the toner for the developer of the present invention, according to the blow-off measuring method, is +10 to +20 μC/g.

Generally carriers of the iron powder type have been used. However, iron powder has a large magnetic saturation capacity and a large specific gravity. Therefore, the required driving torque for the rotation of a sleeve or stirring roller in a developer station increases. Moreover, since the stirring resistance of the iron powder is large, a shear is imposed at the stirring step and adhesion of the toner to the surface of the iron powder readily occurs. Conversely, since the magnetic saturation capacity of granulated magnetite is small ($\frac{1}{2}$ to $\frac{1}{3}$ of iron powder), and the specific gravity of granulated magnetite is small, the stirring resistance and requred driving torque of the developer is small. The use of granulated magnetite is therefore very effective for prolonging the life of the developer. The resultant of measurements of developer station driving torque with respect to spherical iron powder and spherical granulated magnetite are shown in Table 1. It is seen that the driving torque is larger than 10 kg-cm in the case of iron powder but the driving torque is very small; 8 kg-cm in the case of magnetite. Moreover, if the granulated magnetite is surface-coated with a resin and the resin is then heat-cured, adhesion of the toner to the carrier can be prevented.

TABLE 1

Relationship between Material of Carrier and Driving Torque

| Material of Carrier | Shape | Average Particle Size | Driving Torque |
|---|---|---|---|
| iron | spherical | 70 μm | >10 kg-cm |
| granulated magnetite | spherical | 70 μm | 8.0 kg-cm |

Styrene-acrylic resin has been widely used as a toner for hot roll fixation. However, sytrene-acrylic resin is disadvantageous in that when a print sample is interposed between polyvinyl chloride sheets and held in this state, the toner adheres to the polyvinyl chloride sheets and the image disappears. In contrast, for the case of a toner comprising polyester resin, this undesirable phenomenon does not occur and an excellent toner resistance to polyvinyl chloride transfer is obtained. Accordingly, the use of polyester resin as a toner for hot roll fixation has gained popularity. However, use of polyester resin is often restricted because of the following problems.

(1) The pulverizing property of polyester resin during toner preparation is poor, and the pulverized toner has an angular shape therefore a good flowability cannot be attained.

(2) If a wax or the like is used as an offset-preventing agent for the hot roll, flowability is degraded and the toner cannot be uniformly dispensed from a toner hopper. Moreover, clean up of the residual toner from the photoconductor drum after toner transfer is difficult and drum filming readily occurs.

(3) Since polyester resin per se has a strong negative chargeability, polyester resin is suitable as a negatively chargeable toner for performing positive development in a copying machine or the like, but is not suitable as a toner for reversal development in a printer using a positively chargeable photoconductor. Namely, if a positive chargeability is forcibly imparted to the toner in a reversal development printer, by using a charge control agent or the like, the distribution of toner charge increases because of uneven charging, and an increase of the background image readily occurs.

Especially because of problem (3), it has been difficult to realize a positively chargeable toner by using polyester resin.

The present invention provides a novel developer in which an appropriate positive chargeability can be given to a toner while using polyester resin without a charge control agent; thus, solving the problem of toner adhesion to the sleeve in the reversal development process. More specifically, in the present inventon, a positive chargeability is given to a toner comprising a polyester resin of strong negative chargeability by a coating on the surface of a carrier which contains a resin of stronger negative chargeability than the polyester resin itself. Preferably, the optimum toner charge is +10 to +20 μC/g as measured by using a blow-off charge measuring apparatus. If the toner charge is smaller than +10 μC/g, an increase of the background image becomes conspicuous. If the toner charge is larger than +20 μC/g, the print density in solid areas becomes low and adhesion of the toner to the sleeve readily occurs during continuous printing. As pointed out above, an appropriate positive toner chargeability is created by imparting a strong negative chargeability of the surface of the carrier, which is stronger than that of the toner. A coating of toner on the sleeve, which is readily caused when the toner has a positive self-chargeability, can therefore be prevented. Since a uniform positive chargeability is obtained, increased background image and edge blur, which readily occurs when a charge control agent is used, does not occur and an image of high print quality can therefore be obtained.

In connection with the above-mentioned problems (1) and (2), in the present invention, a good flowability is obtained without using a wax, and a polyester resin having an excellent offset-preventing property at the hot roll is used. More specifically, in the present invention, a crosslinked structure is introduced into the molecule of the polyester resin, and the gel fraction of the polymer is 5 to 25%. To obtain a crosslinked structure, trimellitic acid or its anhydride is introduced in the amount of 5 to 30 mole% as the polyester resin-constituting acid component.

Granulated magnetite particles used in the present invention can be prepared by forming a slurry from finely divided magnetite and binder resin, forming spherical particles from the slurry by spray drying or the like, and sintering the particles at a high temperature. Preferably the particle size of the granulated magnetite is 50 to 150 μm. If the particle size is smaller than 50 μm, adhesion of the carrier to the photoconductor readily occurs, and if the particle size is larger than 150 μm, the printed image displays poor resolution.

An ordinary thermosetting resinis used for coating the surfaces of the magnetite particles. For example, the resin; a polybutadiene resin, an alkyd resin, a styrene resin, a styrene-butadiene copolymer, an acrylic resin, a styrene-acrylic copolymer, a styrene-maleic acid copolymer, a polyamide, or an epoxy resin. Since a polybutadiene or styrene-butadiene copolymer has a strong negative chargeability, the resin alone can be used for coating, but in the case of other resins, a negative chargeability should be imported to the resin by dispersing a fluoropolymer powder into the resin. A suitable fluoropolymer, can include for example, polytetrafluoroethylene, a tetrafluoroethylene-hexafluoropropylene copolymer, a tetrafluoroethylene-ethylene copolymer, a tetrafluoroethylene-perfluoroalkylvinyl ether copolymer, or a trifluorochloroethylene resin.

Coating of the carrier is accomplished by dissolving the appropriate resin in an appropriate solvent, adding a curing agent such as a fluoropolymer powder to the solution according to need, and applying the treated resin to the surface of the carrier by spray drying or rotary drying. The fluoropolymer composition is then heat-cured in a thermostatic tank or the like to effect a surface treatment. Preferably the thickness of the coating is 0.1 to 10 μm. If the thickness of the coating is smaller than 0.1 μm, the coating is uneven and a uniform chargeability cannot be obtained. If the thickness of the coating is larger than 10 μm, the electric resistance becomes too large.

Preferably the volume resistivity of the carrier after coating is $10^3$ to 10 Ω-cm. If the resistivity of the carrier after coating is smaller than $10^3$ Ω-cm, adhesion of the carrier to the photoconductor becomes conspicuous. If the resistivity of the carrier after coating is larger than 10 Ω-cm, the effect of the development bias is lost because of tool high an electric resistance and good solid area prints cannot be attained. However to control the resistivity, a magnetite powder or a carbon black powder can be employed.

Preferably the softening temperature of the polyester resin is 125° to 155° C. If the softening temperature of the polyester resin is lower than 125° C., the amount of the low-molecular-weight component must be increased therefore the offset resistance is degraded. If the softening temperature of the polyester resin is higher than 155° C., the melt viscosity is increased at the kneading process on the toner and the dispersibility of a colorant such as carbon black or a dye becomes degraded. Therefore satisfactory results cannot be obtained. Additionally the preferred glass transition temperature of the polyester resin is 60° to 75° C. If the glass transition temperature of the polyester resin is lower than 60° C., blocking of the toner particles readily occurs. If the glass transition temperature of the polyester resin is higher than 75° C., the fixing quality is degraded. In the present invention, the gel fraction of the polyester resin is especially important. Preferably the gel fraction of the polyester resin is 5 to 25%. If the gel fraction of the polyester resin is lower than 5%, a good offset resistance due to the crosslinking of molecules cannot be obtained. If the gel fraction of the polyester resin is higher than 25%, the crosslinking component becomes excessive and the lower-temperature fixing quality is degraded. This gel fraction is related to the ratio of trimellitic acid or its anhydride used as the crosslinking component based on the total acid component, and the amount of trimellitic acid or its anhydride must be 5 to 30 mole%. If the amount of trimellitic acid or its anhydride is smaller than 5 mole%, a good offset resistance cannot be obtained. If the amount of trimellitic acid or its anhydride is larger than 30 mole%, a lower-temperature fixing quality cannot be obtained.

The toner used in the present invention can be prepared according to known procedures. More specifically, the above-mentioned binder resin and colorant are melt-kneaded and uniformly dispersed by a compression kneader, a roll mill or an extruder. The kneaded mixture is finely divided by a pulverizer or a jet mill and is then classified by means such as, an air classifier, to obtain the intended toner.

The present invention will now be described in detail with reference to the following examples that by no means limit the scope of the invention.

Example 1

A resin-coated magnetite carrier (SM111 supplied by Kanto Denka Kogyo, coating thickness=about 3 μm, volume resistivity=$5\times10^7$ Ω-cm) was obtained by coating spherical magnetite particles having a particle size of 79 to 149 μm with a thermosetting epoxy resin containing a polytetrafluoroethylene powder as the charge control agent and a carbon black powder as the electric conductivity control agent, and then heat-curing the prepared resin.

Toner A having a particle size of 10 to 20 μm, was obtained by adding carbon black and a Nigrosine dye to a crosslinking type polyester resin (NE2150 supplied by Kao) having a softening temperature of 148° C., a glass transition temperature of 69° C., and a gel fraction of 18%. Toner A was synthesized using anhydrotrimellitic acid in an amount of 20 mole% based on the total acid component. Melt-kneading pulverizing, and classifying the mixture was used as the toner. Note, when toner A was combined with spherical magnetite before coating, toner A showed a relatively strong negative chargeability of −20 μC/g (toner concentration=4% by weight).

40 g of toner were added to 1 kg of the carrier to prepare a developer A. A continuous printing of 200,000 prints was carried out by using a laser printer of the reversal development system under the conditions shown in Table 2. Printing characteristics were subsequently evaluated. The charge to mass ratio of toner for the developer a was +14 μC/g at the initial stage, and the toner showed a positive chargeability. After 200,000 prints had been obtained by the continuous printing test, no adhesion of the toner to the sleeve was observed.

TABLE 2

| Running Conditions | |
|---|---|
| Photoconductor drum | Se-Te |
| Surface voltage of photoconductor drum | +700 V |
| Development bias voltage | +350 V |
| Drum-sleeve gap | 1.1 mm |
| Blade-sleeve gap | 1.1 mm |
| Hot roll temperature | 170° C. |
| Printing pattern | 4 dots, line pattern (printing ratio = 3%) |
| Toner Consumption | 400 g/10,000 prints |
| Environmental conditions | ambient temperature and humidity |

Figure 2:
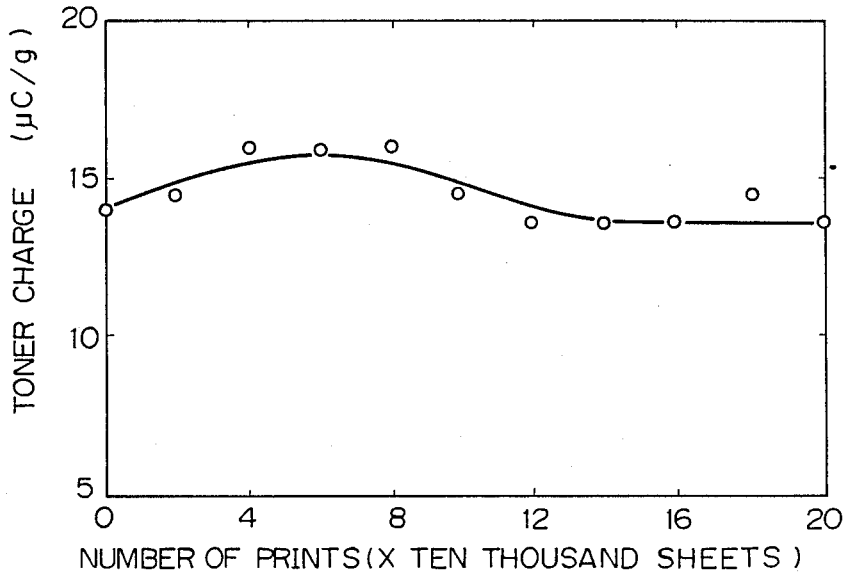
FIG. 2 is a graph showing the change in toner charge (charge per mass) during continuous printing.
Figure 3:
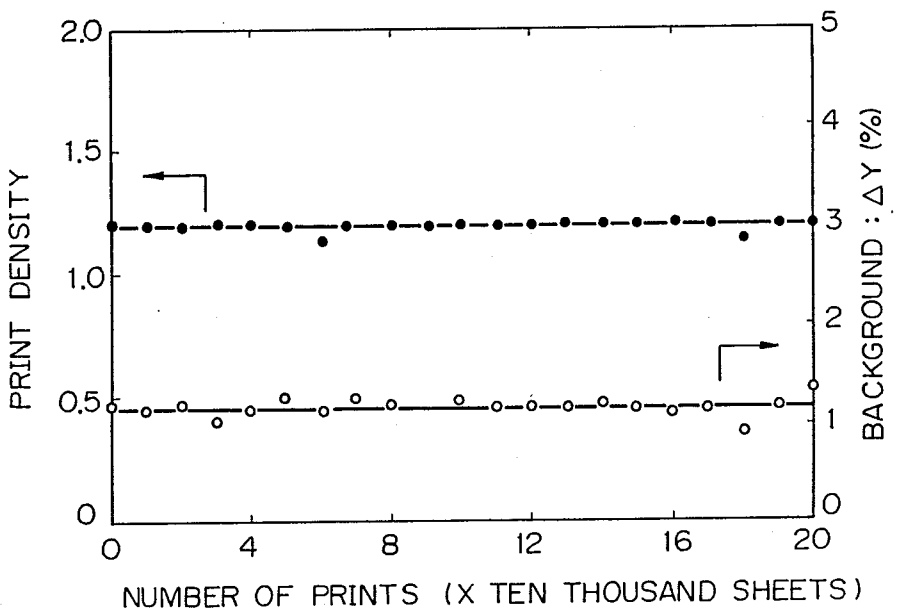
FIG. 3 is a graph showing the changes in print density for solid areas and background during continuous printing.

Changes of the volume resistivity and toner charge were observed during the continuous printing test are shown in FIGS. 1 and 2. When 10,000 to 20,000 prints were obtained, the volume resistivity decreased from the initial value, but no change was observed thereafter and any increase of the electric resistance due to toner filming did not occur. The toner charge was constant and in the range of 13 to 15 μC/g. Changes of the print density for solid areas and background are shown in FIG. 3. It can be seen that no changes occurred. Printing characteristics maintained stability from the initial stage to the 200,000th print.

Figure 4:
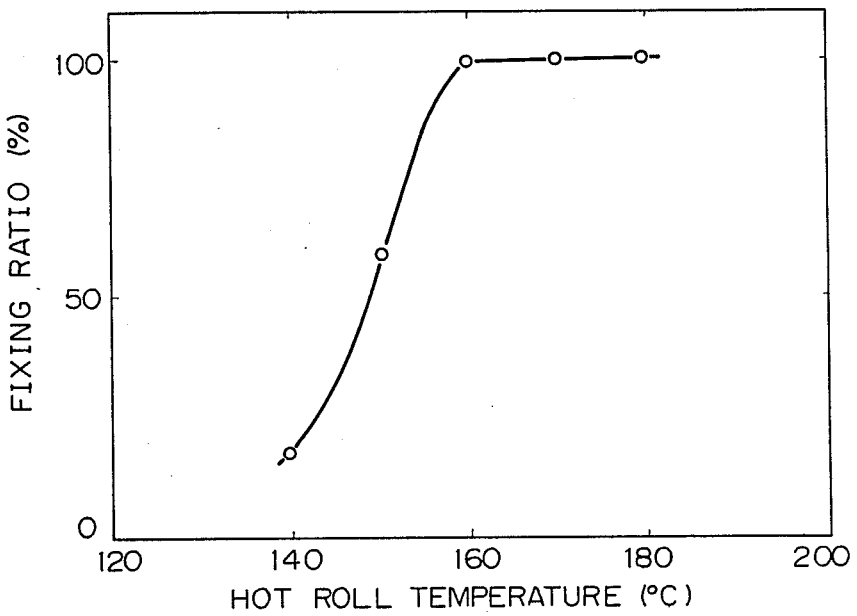
FIG. 4 is a graph showing the relationship between the temperature of the hot roll and fixing ratio.

The resistance to offsetting by the hot roll and fixing quality were evaluated. Offsetting did not occur for hot roll temperatures up to 210° C. The results of the fixing test are shown in FIG. 4. The fixing test was carried out in the following manner. An adhesive tape (3M Company's Number 810 Tape) was lightly applied to the fused image, and an iron roller having a diameter of 100 mm and a thickness of 20 mm was rolled over the tape at a constant speed in the circumferential direction in order to stick the tape to the image. Then, the tape was peeled off and the fixing quality was expressed after peeling to the optical density before peeling. Note, the optical density was measured by a PCM meter supplied by Macbeth Co. As a result of the fixing test, it was discovered that toner A showed a good fixing quality even when the temperature of the hot roll is low, and at fixing temperatures higher than 160° C., the fixing ratio does not substantially change according to the fixing temperature and the fixing ratio is almost 100%.

Example 2

A resin-coated magnetite carrier (coating thickness=about 1 μm, volume resistivity=$1\times10^7$ Ω-cm) was produced by coating spherical magnetite particles having a particle size of 79 to 149 μm with a composition comprising 1,2-polybutadiene (JSR-RB810) as the coating resin, a tetrafluoroethylene resin powder as the charge control agent and a fine magnetite powder as the electric conductivity control agent. The above composition was formed to the rotary drying method and heat-cured to produce the finished carrier.

1 kg of the carrier was added to toner A of Example 1 to prepare a developer B (the toner charge was +18 μC/g). In the same manner as described in Example 1, 200,000 prints were obtained by continuous printing. Adhesion of the toner to the sleeve was not observed even after 200,000 prints had been obtained. As in Example 1, the toner charge, volume resistivity, and print quality did not change therefore continuous printing can be stably performed.

Comparative Example 1

Figure 5:
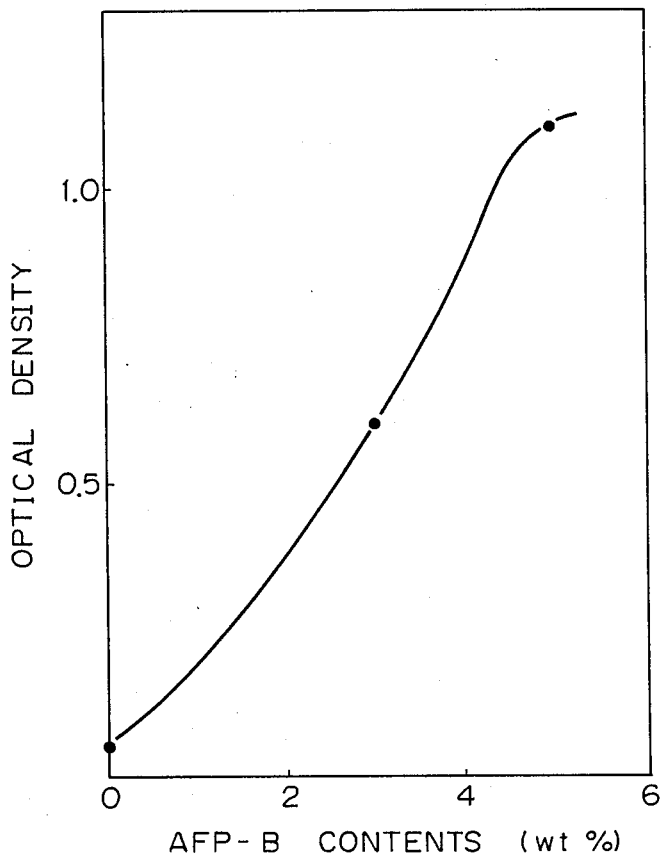
FIG. 5 is a graph showing the relationship between the amount of positive charge control agent and optical density of the toner layer.

A polyamine (AFP-B supplied by Orient Kagaku) was added as the positive charge control agent in the amount of 3 to 5% by weight to the polyester resin used in Example 1. The same colorant as used in Example 1 was used to prepare toners B and C by the same manner described in Example 1. When either toner was combined with the carrier used in Example 1, the toner charge became too high. Accordingly, the heat-curing temperature of the coating resin was reduced in order for the carrier to impart a charge of +15 μC/g. The foregoing toners were combined with this carrier to prepare developers B and C in which each toner concentration was 4% by weight. Using the same laser printer as used in Example 1, 1,000 prints were obtained by continuous printing, and a check was made to see if the toner had adhered to the sleeve surface. The developer on the sleeve was removed, and the toner layer was transferred by an adhesive tape, so that the optical density of the transferred toner could be measured by the same PCM meter supplied by Macbeth Co., as used in Example 1. The results are shown in FIG. 5. For the case of toner A, a toner layer did not substantially form on the sleeve, but in the cases of toners B and C, where the positive chargeability of each toner per se was increased by the addition of a charge control agent, formation of a toner layer on the sleeve was observed. Formation of the toner layer became conspicuous as a greater amount of the charge control agent was added. Moreover, in the case of the developers B and C, after 300 to 500 prints had been obtained, an increase of the background became conspicuous.

Comparative Example 2

A toner D was prepared in the same manner as described in Example 1 except that a polyester resin not including trimellitic acid as the carboxylic acid was used. Toner D was combined with the carrier used in Example 1. Using the same laser printer as used in Example 1, the printing characteristics and offset resistance were examined with respect to the obtained developer. After 20,000 prints had been obtained, a reduction of the print density was observed. When continuous printing was performed at a hot roll temperature of 180° C., contamination of the Image by offsetting was observed.

We claim:

1. A magnetic brush developer for electrophotography by the reversal development method where a uniform positive charge is imparted to a photoconductive insulator, the insulator is irradiated with a light image to form an electrostatic latent image and the latent image is developed and visualized by a positively charged toner, said developer comprising:

a toner having a negartive chargeability and comprising a binder resin of a crosslinked polyester resin;

a carrier having a negative chargeability stronger than the negative chargeability of said toner and comprising granulated magnetite particles; and a thermosetting resin including a fine fluoropolymer powder and either a fine magnetite powder or carbon black powder dispersed therein, said thermosetting resin coating the surfaces of said granulated magnetite particles.

2. A developer as set forth in claim 1, wherein said crosslinked polyester resin has a gel fraction of 5 to 25%.

3. A developer as set forth in claim 2, wherein said polyester resin contains 5 to 30 mole% of trimellitic acid or its anhydride as a crosslinking agent.

4. A developer as set forth in claim 2, wherein said polyester resin has a softening temperature of 125° to 155° C.

5. A developer as set forth in claim 2, wherein said polyester resin has a glass transition temperature of 60° to 75° C.

6. A developer as set forth in claim 2, wherein said thermosetting resin coats said granulated magnetite particles to a thickness of 0.1 to 10 μm.

7. A developer as set forth in claim 2, wherein said carrier has a volume resistivity of $10^3$ to 10 Ω-cm.

8. A developer as set forth in claim 2, wherein said toner has a charge to mass ratio of +10 to +20 uC/g.

* * * * *

UNITED STATES PATENT AND TRADEMARK OFFICE

CERTIFICATE OF CORRECTION

PATENT NO. : 4,849,317

DATED : July 18, 1989

INVENTOR(S) : Norio Sawatari et al.

It is certified that error appears in the above-identified patent and that said Letters Patent is hereby corrected as shown below: Title page:

In the Abstract - line 15, "is" s/b --does--.

Col. 3, line 31, "conductivety" s/b --conductivity--;
line 45, "surface" s/b --surfaces--;
line 56, "mgne-" s/b --magne--.

Col. 4, line 48, "requred" s/b --required--.

Col. 5, line 57, delete "strong", "of" s/b --to--.

Col. 6, line 19, "resinis" s/b --resin is--;
line 21, "resin," s/b --resin may be--;
line 28, "imported" s/b --imparted--;
line 49, "10" s/b --$10^{10}$--;
line 53, "10" s/b --$10^{10}$--;
line 54, "tool" s/b --too--;
line 55, "However" s/b --However,--
(grammatically incorrect).

Col. 7, line 64, "of toner for" s/b --of the toner--;
line 65, "a" s/b --A--.

Col. 8, line 16, after "test" insert --and--;
line 38, after "expressed" insert --and evaluated as a percentage of the optical density--.

UNITED STATES PATENT AND TRADEMARK OFFICE

CERTIFICATE OF CORRECTION

PATENT NO. : 4,849,317

DATED : July 18, 1989

INVENTOR(S) : Norio Sawatari et al.

It is certified that error appears in the above-identified patent and that said Letters Patent is hereby corrected as shown below:

Col. 9, line 15, "Using" s/b --By using--.

Claim 1, line 13, "negartive" s/b --negative--;

Claim 7, line 40, "10" s/b --$10^{10}$--.

Signed and Sealed this

Third Day of April, 1990

*Attest:*

HARRY F. MANBECK, JR.

*Attesting Officer*

*Commissioner of Patents and Trademarks*